United States Patent [19]

Böving

[11] 3,935,720

[45] Feb. 3, 1976

[54] ROTATABLE CYLINDER LOCK

[76] Inventor: Egon Böving, Wulfrather Str. 2a, 56.6 Tonisheide, Rhineland, Germany

[22] Filed: Oct. 24, 1974

[21] Appl. No.: 517,843

[30] Foreign Application Priority Data

| | | |
|---|---|---|
| Oct. 25, 1973 | Germany | 2353407 |
| Feb. 6, 1974 | Germany | 2405580 |
| Mar. 21, 1974 | Germany | 2413555 |

[52] U.S. Cl. ..... 70/276; 70/356; 70/365

[51] Int. Cl.² ..... E05B 47/00

[58] Field of Search ..... 70/276, 356, 365, 366, 70/421

[56] References Cited

UNITED STATES PATENTS

| | | | |
|---|---|---|---|
| 3,486,355 | 12/1969 | Halfyard | 70/421 |
| 3,499,302 | 3/1970 | Spain et al. | 70/364 A |
| 3,499,303 | 3/1970 | Spain | 70/364 A |
| 3,654,782 | 4/1972 | Heimann | 70/276 |
| 3,722,240 | 3/1973 | Spain et al. | 70/364 A |
| 3,855,827 | 12/1974 | Hallman et al. | 70/134 |

FOREIGN PATENTS OR APPLICATIONS

| | | | |
|---|---|---|---|
| 844,299 | 6/1970 | Canada | 70/421 |

*Primary Examiner*—Albert G. Craig, Jr.
*Attorney, Agent, or Firm*—Ernest G. Montague; Karl F. Ross; Herbert Dubno

[57] ABSTRACT

The rotatable plug of a cylinder lock has an axially extending outwardly open cavity paralleling a key slot and normally registering with an axially extending groove in the inner wall surface of the surrounding cylinder, the groove and the cavity being bridged by a locking bar with sloping flanks cammable radially inwardly, against the force of compression springs within the recess, upon rotation of the plug relative to the cylinder. Seated in the cavity are a plurality of axially spaced tumblers which are freely rotatable about pins transverse to the cylinder axis and have recesses alignable, in a predetermined operating position, with respective projections on the locking bar to enable the inward camming of the latter; each tumbler carries a pair of permanent magnets confronting a thin partition between the cavity and the key slot. Upon insertion of the right key into the slot, pairs of magnets on the key surface adjoining the partition coact with the magnets on the tumblers to align their recesses with the associated projections on the locking bar. A longitudinal rib on the key, fitting into an axially extending channel of the key slot, prevents improper insertion of the key and has a notch engageable by a spring-loaded latch, transversely slidable in the plug near its entrance end, which blocks rotation of the plug if a key or other object is partly introduced into the slot.

11 Claims, 16 Drawing Figures

VI
VI
109
108
155
156
128
154
111
124
126
123
124
126
110
123
101
104
115
119
116
122
125
118
122
116
125
117
122
130
102
103
137
135
136
139
140
144
143
102'
106
114
127
129
105
131
107
107'

ROTATABLE CYLINDER LOCK

FIELD OF THE INVENTION

My present invention relates to a lock assembly wherein a cylindrical housing surrounds a rotatable plug provided with a key slot, the plug being normally held in a predetermined rotary position by a set of tumblers which are displaceable by the insertion of a key into the slot to permit rotation of the plug into an off-normal position with entrainment of a latch bolt or the like.

BACKGROUND OF THE INVENTION

It has already been proposed to design the tumblers as disks rotatable about transverse axes and to control their rotation with the aid of magnets carried on the key. According to German Pat. No. 1,553,365, the disks and the housing are provided with complementary formations which permit a rotation of the plug only upon proper alignment thereof with one another. A difficulty inherent in that construction is the fact that the disks must be firmly seated in complementary bores of the plug, in order to resist the pressure exerted thereon when an attempt is made to open the lock with the aid of an improper key or tool, and that consequently the magnetic force must overcome an elevated frictional resistance. Also, intruding dust particles or the like may further impede the rotation of the tumblers. Finally, the large pressures exerted on the tumblers by projections of the housing — on an attempt to force the lock — may seriously damage the mechanism and prevent its subsequent response to the use of the proper key.

OBJECTS OF THE INVENTION

It is, therefore, an important object of my present invention to provide an improved lock assembly of the general type referred to which avoids these drawbacks.

Another object is to provide ancillary blocking means in such a lock assembly for preventing rotation of the plug from its normal position if a key is only partly inserted, thereby protecting the main locking mechanism from strains which could otherwise arise even in the normal use of the lock.

SUMMARY OF THE INVENTION

In accordance with my present invention, a plug is provided with an axially extending cavity open to the periphery thereof, this cavity normally registering with an axially extending groove on the inner peripheral housing wall. The cavity contains locking means, preferably in the form of a continuous bar, biased radially outwardly for engagement with the groove in the normal plug position, the groove and the locking means having complementary profiles provided with sloping flanks for camming the locking means generally radially inwardly open incipient rotation of the plug from its normal position. The cavity further contains a plurality of axially spaced tumblers independently rotatable about generally radial axes, such rotation being induced by preferably magnetic control means on the shank of a key inserted into a key slot adjacent the cavity. Complementary formations on the locking means and the tumblers matingly confront one another in predetermined angular positions into which the tumblers are rotatable by the control means of the key upon full insertion thereof; in any other tumbler position the inward camming of the locking means is prevented by a disalignment of the coacting formations.

With this construction, therefore, the tumblers no longer come into direct contact with any part of the cylinder housing but act only upon the locking bar which slides rather than rotates in the plug and which can be made as sturdy as is necessary to prevent forcing of the lock. Since the bar is urged radially outwardly by its biasing means, it normally stands clear of the tumblers which therefore can rotate freely on their bearings, the latter being preferably formed by a plurality of axle pins rising from a magnetically pervious partition between the cavity and the key slot. The term "magnetically pervious" (not to be confused with "permeable") denotes the quality of letting the magnetic flux pass without substantial attenuation; thus, if the partition consists of steel or other ferromagnetic material, it should be so thin as not to form a significant magnetic shunt. The plug can be unitarily cast with the axle pins integrally rising from the partition.

If the locking bar is movable along an axial plane of the plug containing the axes of rotation of the tumblers, the axle pins will be substantially unaffected by the pressure exerted upon the tumblers in an attempt to force the lock. This pressure, in any event, is only a fraction of that sustained by the bar itself.

Pursuant to a further feature of my invention, the locking bar and the complementary groove of the cylinder housing are of generally trapezoidal cross-section with radially outwardly converging sides, the width of the cavity slightly exceeding the major base of the trapezoid whereby the locking bar is limitedly tiltable in the cavity. In that instance the coacting formations on the tumblers and the bar are eccentric recesses on the disk-shaped tumblers and projections on at least one lateral edge of the bar bracketed by somewhat longer lateral teeth extending from the major base of the trapezoidal bar profile, these teeth being brought into contact with an adjoining cavity wall by a tilting of the bar upon an incipient rotation of the plug blocked by nonalignment of at least one projection with a recess on a confronting tumbler. Thus, the projections of the bar are held out of contact with the cavity wall and are protected against deformation which would impair the function of the mechanism.

It is, however, also possible to let the locking bar slide along the partition itself, in a direction perpendicular to the axial plane of the tumbler disks, with projections extending in the same perpendicular direction toward that axial plane; the complementary recesses are then peripheral cutouts on the tumbler disks. If an attempt is made to force such a lock, only a minor component of the exerted torque is translated into a pressure acting radially upon the tumblers; to prevent even that limited pressure from possibly deforming the axle pins, I prefer to provide backstops for the tumblers on their sides diametrically opposite from the confronting projections. The backstops are advantageously formed by heels integral with inserts in apertures of the plug body, these inserts also forming counterbearings for the tumblers in line with their axle pins.

According to another feature of my invention, the plug is provided at an entrance end of its key slot with a transverse bore in which a spring-loaded detent is slidable. A depression in the housing is engageable by an extension of this detent for immobilizing the plug when the detent is repressed against its spring force, e.g. by a partially inserted key; upon full insertion of the key, a notch in its shank releases the detent from its immobilizing position to permit rotation of the Plug in the housing while blocking the withdrawal of the key in an off-normal plug position. If desired, the housing may also be provided with a second depression angularly offset from the first one to facilitate withdrawal of the key into an alternate position, e.g. one offset by 90° from the normal plug position.

Advantageously, in order to avoid any weakening of the key body, the notch is formed as a discontinuity in a longitudinal guide rib of the key shank which fits into an axially extending channel of the plug to establish a definite insertion position for the key.

A lock assembly according to my invention can be realized with a relatively small number of tumblers, preferably three. When the key is withdrawn, these tumblers will assume individual positions of disalignment into which they may be brought by the withdrawal motion of the key magnets and/or by their own mutual attraction if the tumblers carry active permanent magnets. Supplemental biasing means such as hair springs could be used for this purpose if necessary.

If a series of locks of this type are to be openable by a master key, one or more tumblers (e.g. a single tumbler in a three-tumbler lock) may be provided with two recesses or equivalent formations each, one recess being differently positioned with reference to the associated magnets on different locks whereas the other recess has the same relative position in each instance. The individual keys, all different from one another, will then be operative to align the first recess of that tumbler (or group of tumblers) with the corresponding projection of the locking bar whereas the master key so aligns the second recess. Naturally, the remaining tumbler or tumblers will then have to be identical for all the locks of the series in order to be properly orientable by both the individual keys and the master key.

BRIEF DESCRIPTION OF THE DRAWING

The above and other features of my invention will now be described in detail with reference to the accompanying drawing in which.

SPECIFIC DESCRIPTION

Figure 1:
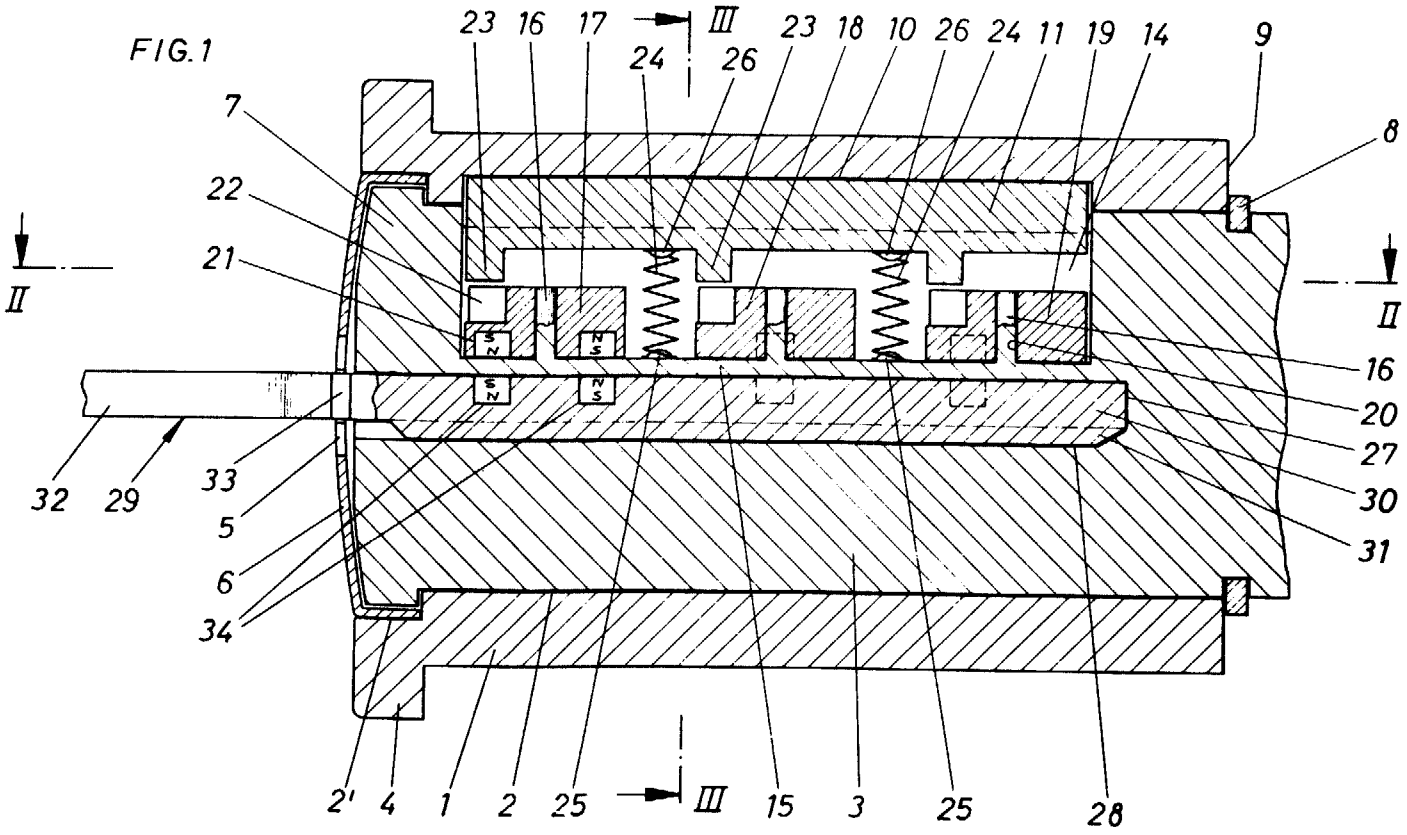
FIG. 1 is an axial sectional view of a lock assembly embodying my invention.

In FIGS. 1 – 4 I have shown a cylindrical lock housing 1 whose bore 2 receives a cylindrical plug 3 coaxial with the housing. Bore 2 has an enlarged front end 2′ accommodating a dust cap 6 which has a slit 5 aligned with an axially extending slot 27 for the insertion of the shank 30 of a key 29. Cap 6 embraces a head 7 of plug 3 which, together with a split ring 8 engaging the rear face 9 of housing 1, holds the plug in an axially fixed position.

An axially extending groove 10 in the inner peripheral wall of housing 1 communicates with the bore 2 and accommodates a locking bar 11 of complementary, generally trapezoidal profile, with sloping flanks 10′ and 10″ of groove 10 normally engaging similar flanks 11′ and 11″ of bar 11. The latter flanks 11′ and 11″ merge into short parallel side faces 12 and 13 of the bar slidably guided by side walls 14′ and 14″ of an axially extending cavity 14 in plug 3 which is substantially coextensive with groove 10 registering therewith in a normal rotary position illustrated in FIGS. 1 and 3. Cavity 14 is separated from the key slot 27 by a thin-walled partition 15 of magnetically pervious material, this partition carrying bumps 25 which confront similar bumps 26 on bar 11 and serve to hold in position a pair of compression springs 24 urging the bar 11 radially outwardly into groove 10.

Three axially spaced pins 16, rising integrally from partition 15, serve as bearing axles for three disk-shaped tumblers 17, 18 and 19 which are independently rotatable within cavity 14 about coplanar axes lying in a common axial plane of plug 3, these tumblers having central bores 20 receiving the pins 16. With pins pointing upwardly in the normal position of FIGS. 1 and 3, as illustrated, gravity will suffice to hold the tumblers close to the partition 15. Each tumbler carries on its underside a pair of permanent bar magnets 21 attractable by coacting bar magnets 34 on key shank 30 into angular positions illustrated in FIGS. 1 and 2 in which peripheral recesses 22 on tumblers 17 – 19 are aligned with respective projections 23 on the underside on locking bar 11. The complementary shapes of recesses 22 and projections 23 allow the bar 11 to be cammed radially inwardly when, with the key 29 fully inserted into slot 27, the head 32 of the key is rotated together with plug 3 (e.g. clockwise, as indicated by an arrow $x$ in FIG. 3) into an off-normal position with resulting displacement of a nonillustrated latch bolt or the like driven in the usual manner by the rotating plug. Upon incipient rotation in that direction, flank 10″ of groove 10 cammingly engages the corresponding flank 11″ of bar 11, thereby generating a radial thrust if the angle of inclination of these flanks with reference to the plane of symmetry P of bar 11 is larger than the angle of friction. The difference between the flank angle and the angle of friction may be quite small since the resulting thrust need only suffice to shift the bar inwardly when there is no obstacle to its displacement, i.e. when the formations 22 and 23 are properly aligned with each other. If this is not the case, one or more of the projections 23 will come to rest upon the solid upper faces of the confronting tumblers ly - 19 but will not subject these tumblers to objectionable stress inasmuch as most of the torque is absorbed by the housing 1 and the bar 11 bearing directly upon the plug 3. I have found that an applied torque of up to 9 meter-kiloponds will not lead to any material deformations interfering with the subsequent operation of the locking mechanism.

Figure 4:
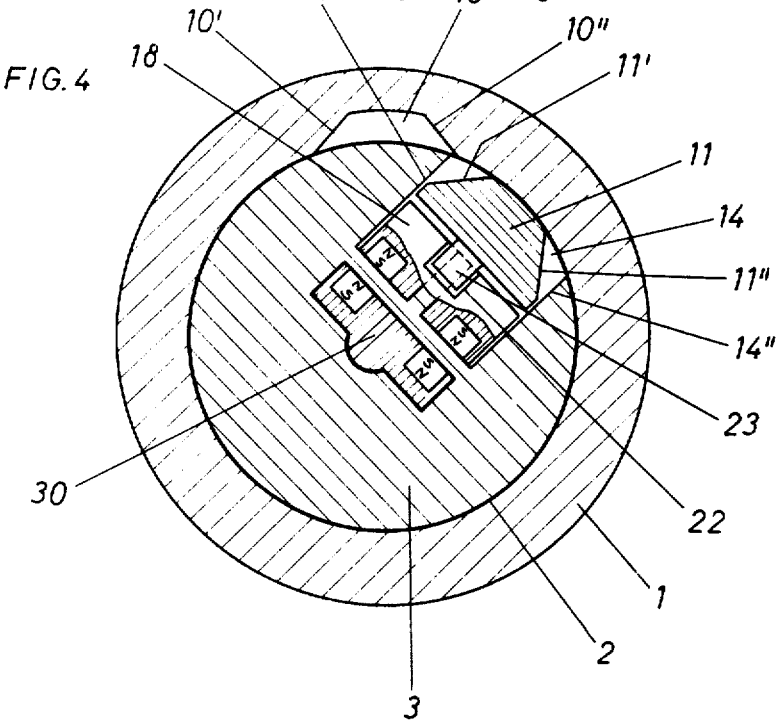
FIG. 4 is a cross-sectional view similar to FIG. 3, illustrating an off-normal position.

The key slot 27 has a rectangular cross-section, except for a bulge at the center of its underside forming a longitudinal channel 23 to receive a rib 31 on the lower surface of key shank 30, i.e. the surface opposite the one bearing the magnets 34. The presence of this rib prevents insertion of the key in an inverted position in which the magnets 34 would not properly coact with the magnets 21 of the tumblers. Notches 33 on the narrow key edges, between head 32 and shank 30 of key 29, are engaged by portions of cap 6 between arms of its cruciform slit 5 to permit insertion and withdrawal of the key only in two mutually orthogonal positions but not in an intermediate position as shown in FIG. 4.

Figure 2:
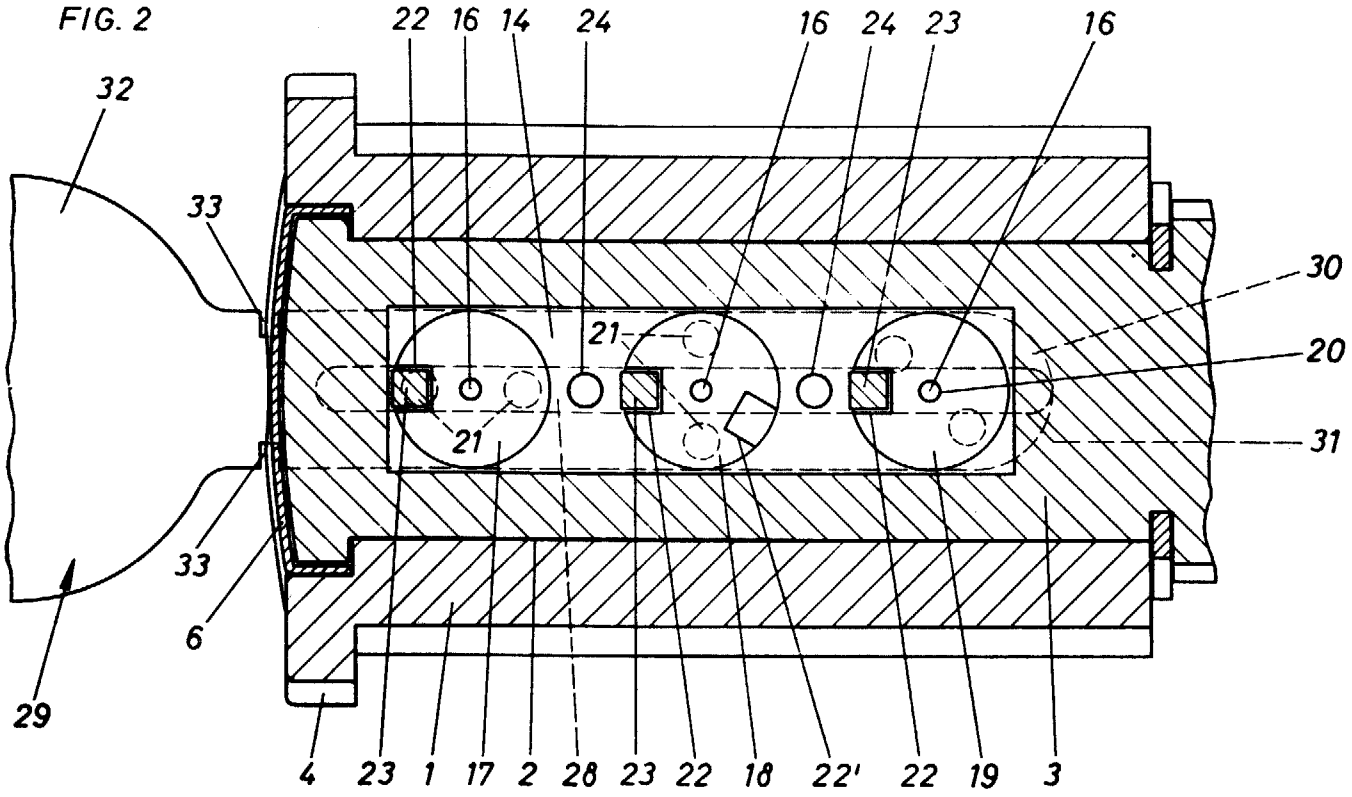
FIGS. 2 and 3 are longitudinal and transverse sectional views taken on lines II — II and III — III of FIG. 1, respectively.
Figure 3:
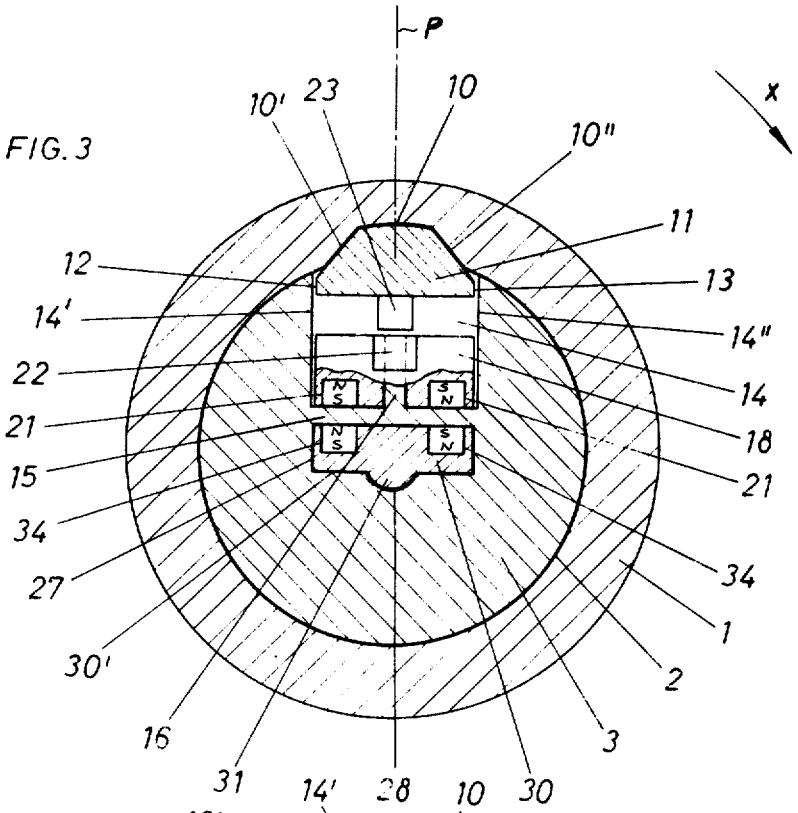

Upon withdrawal of the key 29, interaction between the magnets 21 of adjoining tumblers 17 – 19 dislodges these tumblers from their position of alignment so that plug 3 cannot be rotated with the aid of an inserted tool other than the key 29 or an equivalent master key. Such a master key has magnets so oriented as to place the recess 22 of tumblers 17 and 19 in the same position into which they are rotated by the individual key 29, as illustrated in FIG. 2, while imparting to tumbler 18 an orientation in which a second recess 22' occupies the position of alignment with the associated projection 23. The relative positions of magnets 21 and recesses 22 on tumblers 17 and 19 is the same for all the locks of the series, as is the relative position between the magnets 21 of tumbler 18 and recess 22' thereof; recess 22 of tumbler 18, however, has a different relative position for each lock.

If an attempt is made to jimmy the lock, at most one of the tumblers 17 – 19 could be placed in the correct position; the others, being independently rotatable, could not be so oriented without the correct key.

The system of FIGS. 5 – 9 is generally similar to the one described above and the same reference numerals have been used, supplemented by a "L" in the position of the hundreds digit, to designate analogous elements. These elements, therefore, will be referred to only as far as is necessary for an understanding of the specific features peculiar to the present modification.

The cylinder housing 101 is here shown provided with two axially extending grooves 110 and **110*a*, angularly offset by 90°, defining two rotary positions from which the plug 103 can be dislodged only with the aid of the proper key 129. Groove 110*a* has the same shape as groove 110** and, therefore, need not be described in detail.

Figure 7:
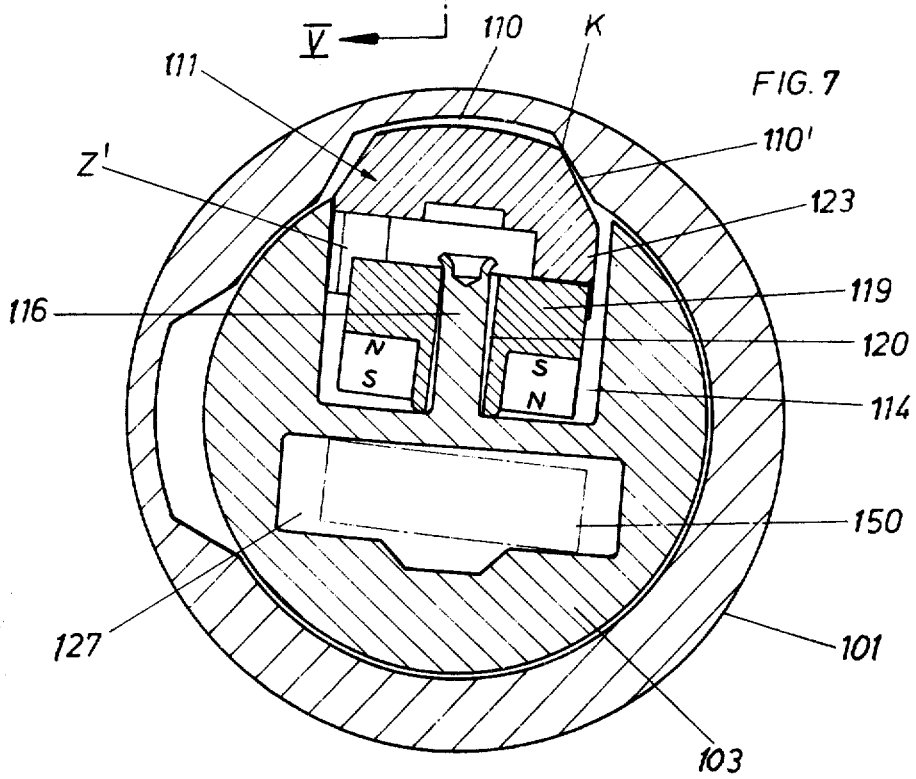
FIG. 7 is a cross-sectional view similar to FIG. 6, illustrating the blocking of rotation upon an attempted forcing of the lock.
Figure 8:
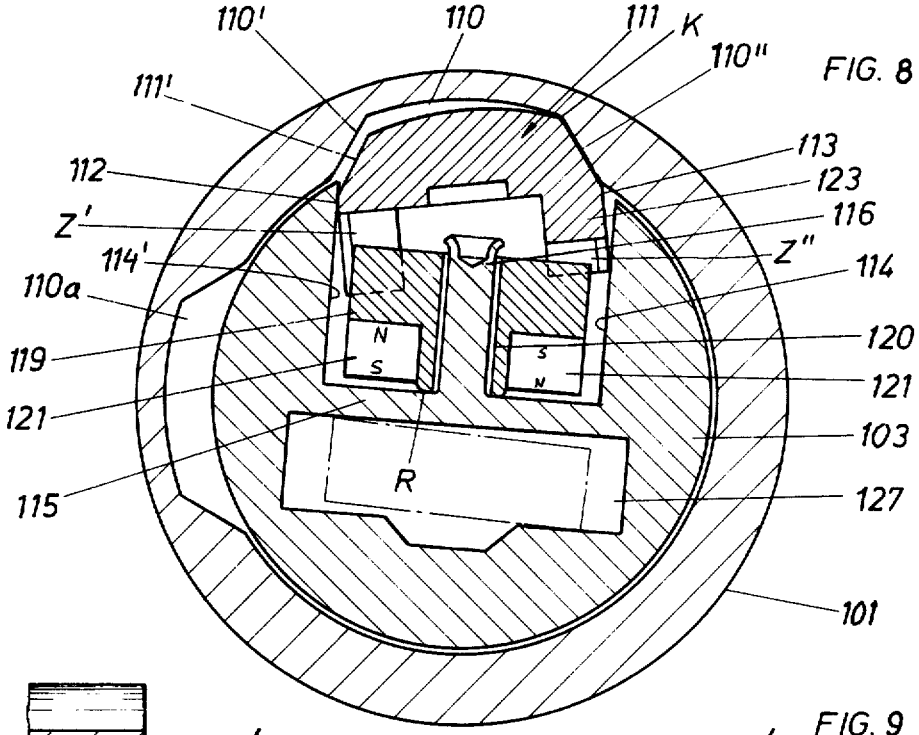
FIG. 8 is a view similar to FIG. 7, illustrating the final blocking position.
Figure 9:
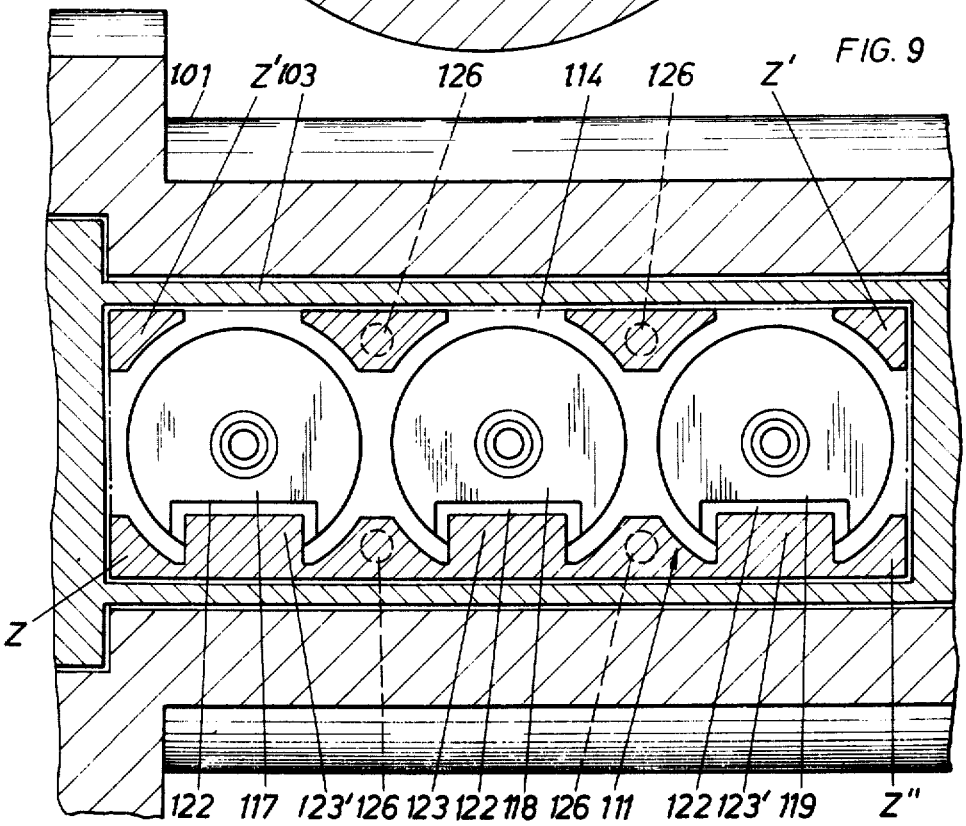
FIG. 9 is a fragmentary longitudinal sectional view taken on the line IX — IX of FIG. 6.

Tumblers 117, 118 and 119 are mounted with a certain play on their pins 116, integral with partition 115, and are bracketed by two sets of teeth Z', Z'' extending from the broad lower surface of the locking bar 11 along opposite edges thereof. Projections 123, disposed asymmetrically on that bar, are shorter than the teeth Z', Z'' and are sandwiched between the teeth Z'' at one edge thereof. Cavity 114 is somewhat wider than bar 111 which is therefore limitedly tiltable therein, as illustrated in FIGS. 7 and 8, and which also is received with some play in groove 110; tumblers 117 – 119, by virtue of their loose mounting, can initially follow the tilting of bar 111 upon an incipient rotation of the plug 103 in a clockwise sense (FIG. 7) in a position of non-alignment in which one or more of the projections 123 come to rest on the upper tumbler surfaces. Thus, if an intruder tries to force the lock by inserting a tool 150 into the key slot 127, the lock will jam as the bar 111 moves beyond the position of FIG. 7 into that of FIG. 8 by virtue of the camming action exerted by the groove flank 110'' upon an edge K of the bar. In this jamming position, in which the bar flank 111' lies flat against the groove flank 110'', the teeth Z'' bear upon the right-hand wall 114'' of cavity 114 while the opposite cavity wall 114' is contacted by the edge 112 of bar 111; thus, the projections 123 do not engage any part of plug 103 and are also lifted off the tumblers 117 – 119 in this jamming position. If force were applied in the reverse direction, i.e. with counterclockwise rotation of plug 103 from the position of FIG. 6, bar 111 would touch the cavity walls 114' and 114'' by its edge 113 and its teeth Z', respectively; in that case, with bar flank 111' lying flat against groove flank 110', the projections 123 would be approximately in the position of FIG. 7 and would rest only lightly on the confronting tumblers 117 – 119.

Figure 5:
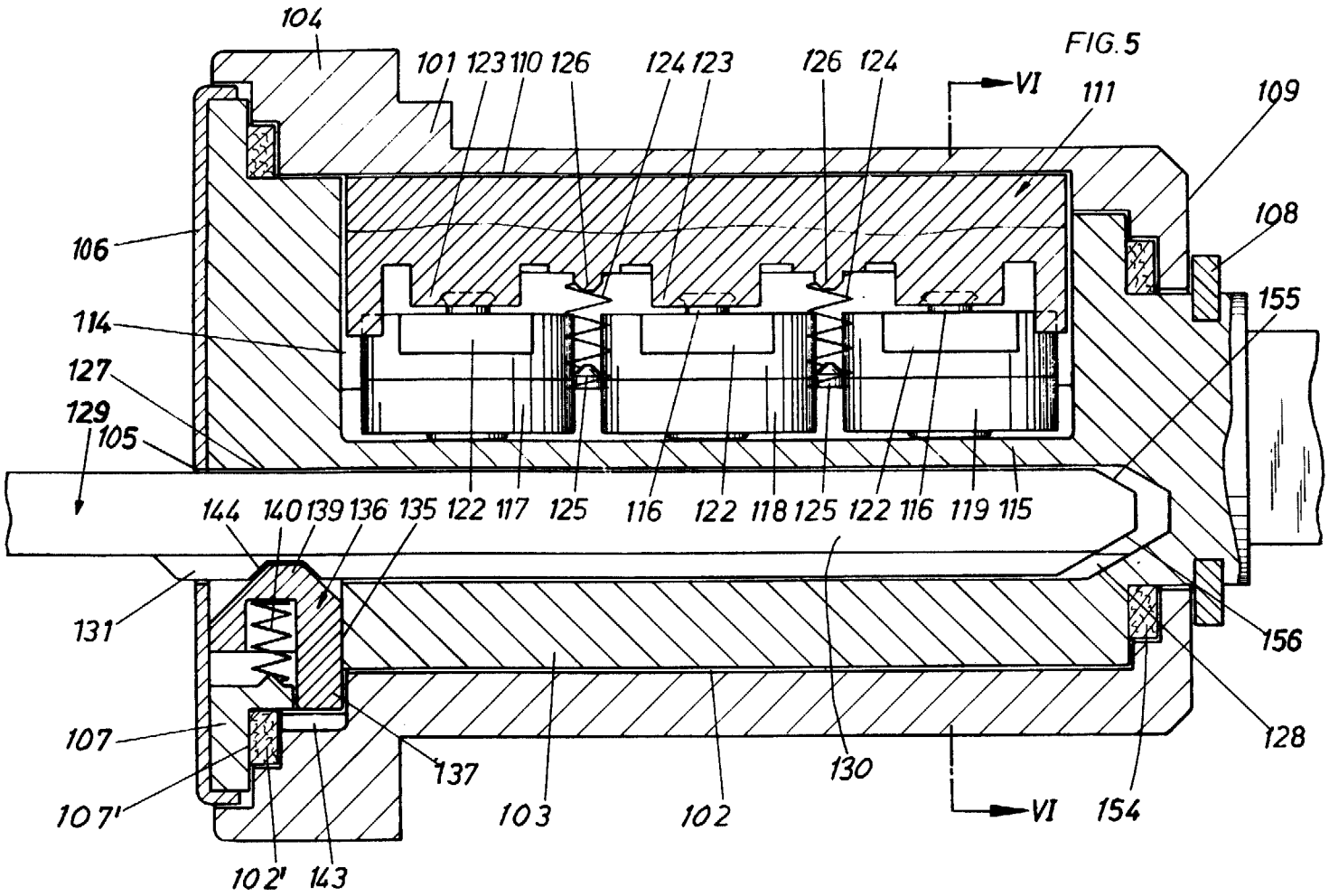
FIG. 5 is a sectional view similar to FIG. 1, taken on the line V — V of FIG. 6, illustrating a modification.
Figure 6:
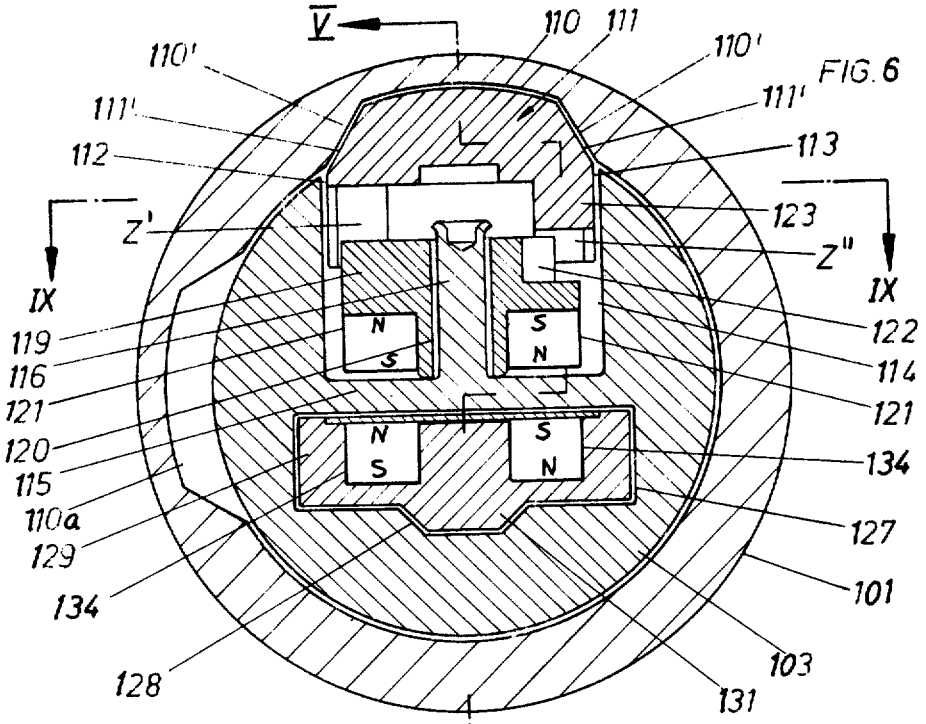
FIG. 6 is a cross-sectional view taken on the line VI — VI of FIG. 5.

As illustrated in FIG. 5, plug 103 is provided with a transverse passage 135 near its front end, i.e. close to its head 107, which accommodates a radially slidable detent 136 under pressure of a spring 140 urging a point 139 of that detent into a notch 144 of the shank 130 of key 129; notch 144 constitutes a discontinuity in the guide rib 131 of the key and registers with detent 136 only upon full insertion of the key into the slot 127, i.e. in a position in which the key-supported magnets 134 properly coact with the tumbler magnets 121. In this inserted position, readily recognized by the user as the point 139 enters the notch 144, the key is yieldably indexed by the spring-loaded detent 136 so as to be kept from falling out of the lock, e.g. upon the slamming of a door on which the lock is mounted. An extension 317 of key 136 registers with a depression 143 in housing 101 to prevent rotation of the plug 103 if the detent 139 is completely repressed by the rib 131 upon only partial insertion of the key 129. On the other hand, detent 136 prevents the extraction of key 129 from slot 127 in any off-normal position in which its extension 137 is disaligned from depression 143. As described hereinafter with reference to FIGS. 12 – 16, which show further structural details of such a detent, the depression 143 may be duplicated at an angularly offset location (opposite groove **110*a*** in this instance) to facilitate withdrawal and reinsertion of the key in a normal and in an alternate working position.

The mouth of the bore 102 of housing 101 has a step 102' forming a seat for a packing ring 107'; a similar packing ring 154 is lodged in the opposite housing end. Ring 107' forms a forward boundary for the depression 143, and any companion depression thereof, preventing the ingress of dust. The insertion end of key shank 130 has beveled edges 155 and 156, the latter edge coacting with a sloping front face of detent 136 which obstructs the slot 127 in the absence of key 129; upon introduction of the key into the slot, the detent 136 is cammed aside by the edge 156 against the force of its loading spring 140.

Figure 10:
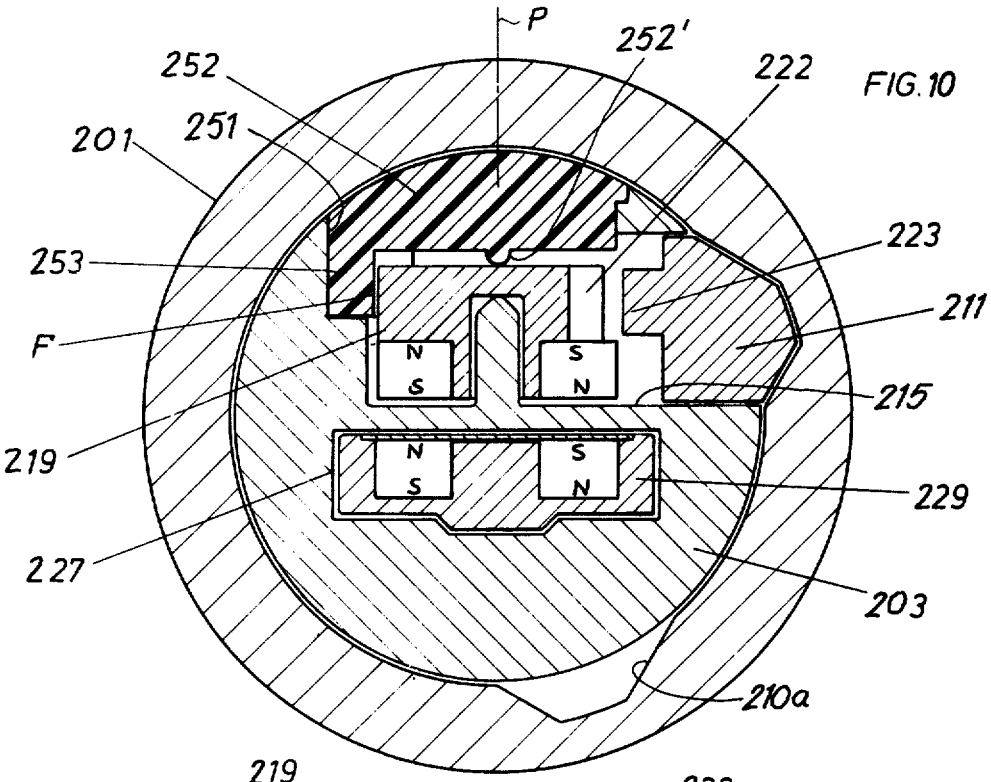
FIGS. 10 and 11 are cross-sectional views of another embodiment in a normal and in a blocking position, respectively.
Figure 11:
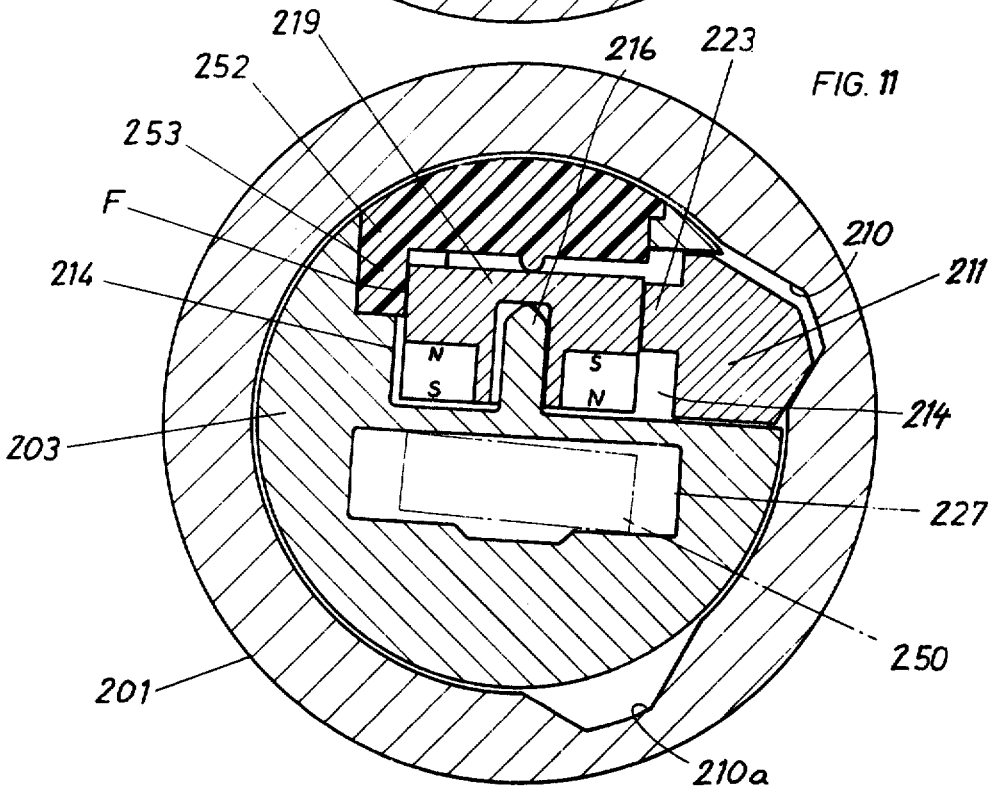
Figure 12:
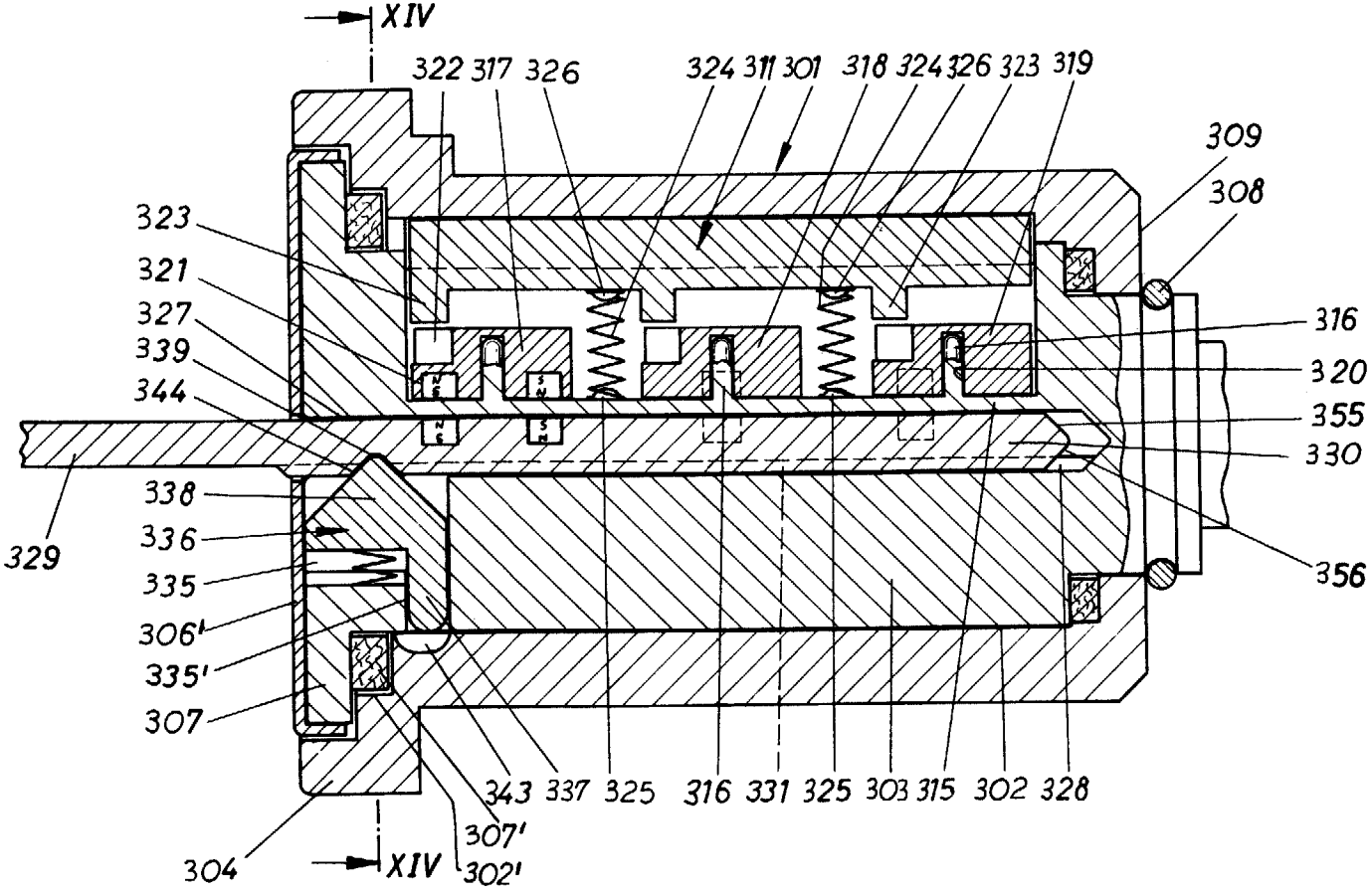
FIG. 12 is a longitudinal sectional view similar to FIGS. 1 and 5, showing a further embodiment.
Figure 13:
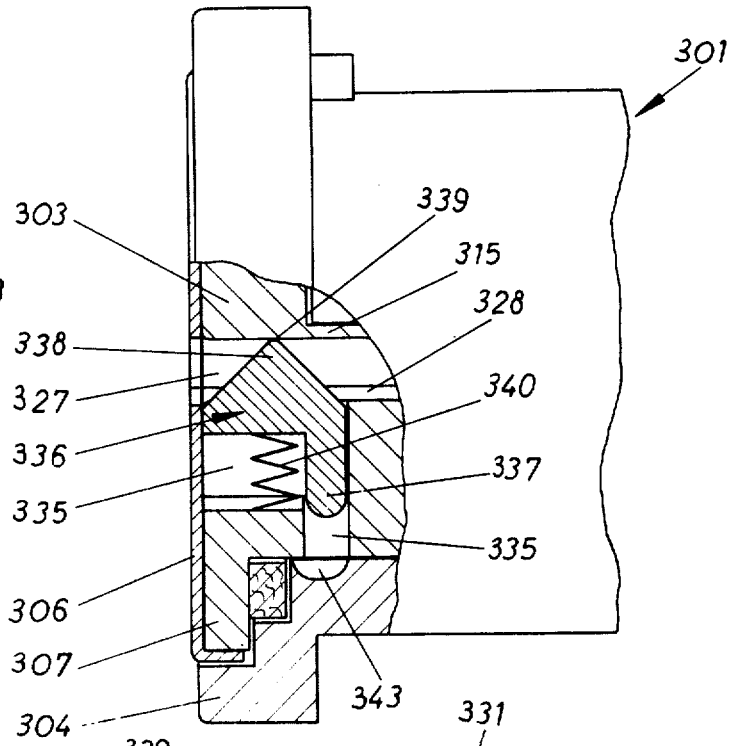
FIG. 13 is a side-elevational view (parts broken away) of a front portion of the lock of FIG. 12 with the key removed.
Figure 14:
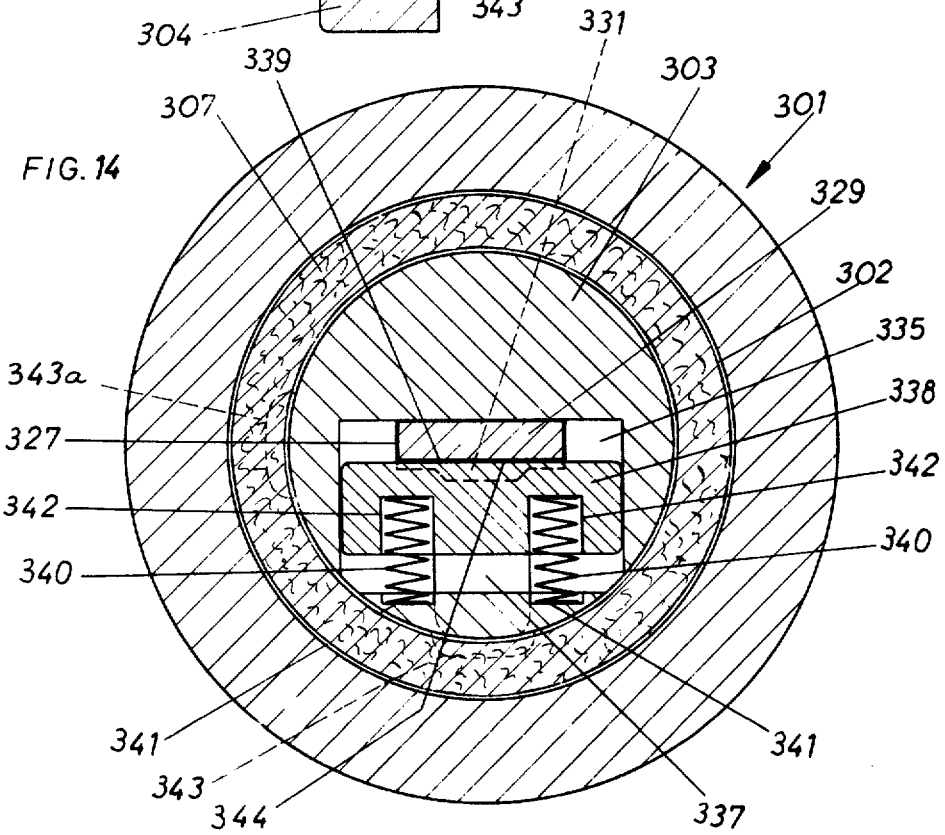
FIG. 14 is a cross-sectional view taken on the line XIV — XIV of FIG. 12 and showing the assembly in a normal position with key inserted.
Figure 15:
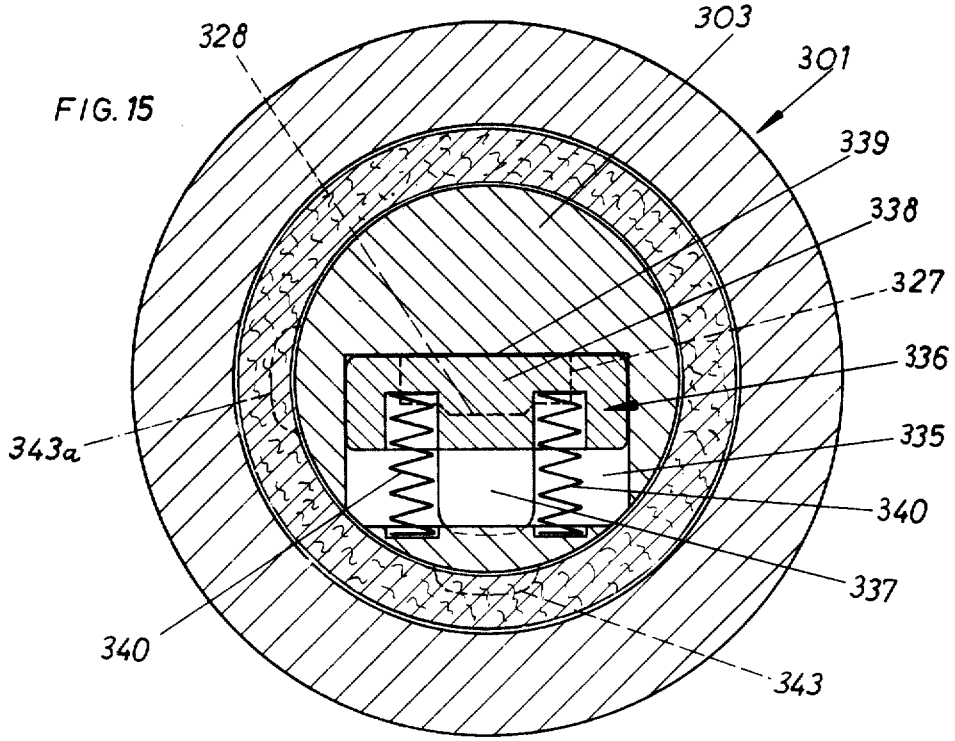
FIG. 15 is a view similar to FIG. 14, showing the same position with key removed.

In FIGS. 10 and 11, in which elements corresponding to those of earlier Figures have been identified by similar reference numerals with a "2" in the position of the hundreds digit, I have shown an alternate arrangement wherein the locking bar 211 is slidable on the partition 215 which separates the cavity 214 from the key slot 227. Housing 201 is again shown provided with two grooves 210 and 210*a*, spaced 90° apart, which accommodate the bar 211 in the normal position of FIG. 10 and in an alternate position at right angles thereto.

Locking bar 211 carries projections 223 coacting with peripheral cutouts 222 in the associated tumblers, such as the tumbler 219 visible in FIGS. 10 and 11. Upon incipient rotation of tumbler 203 relative to housing 201, locking bar 211 is again cammed substantially radially inwardly, i.e. toward an axial plane P of housing 201 which includes the axes of rotation of the tumblers. In this instance, axle pins 216 are received with a certain amount of play in blind bores of the tumblers which are thereby held out of contact with partition 215; counterbearings for the tumblers are formed by bosses 252' on respective inserts 252 which are firmly fitted into apertures 251 of housing 201 above each tumbler and which serve to close these apertures after they have been used for the emplacement of the tumblers. Inserts 252, which could be made from metallic or nonmetallic (e.g. plastic) material, are provided with integral heels 253 which form arcuate backstop surfaces F for the associated tumblers diametrically opposite from the projections 223. Thus, if an attempt is made to force the lock with the aid of a tool 250, the radial pressure exerted by the depression 223 upon the tumbler 219 is absorbed by the heel 253 and does not lead to a deformation of axle pin 216. Normally, in view of the clearances provided, the tumblers are able to turn freely also in this embodiment. Biasing springs for the locking bar 211, bearing upon that bar and upon the opposite cavity wall 214' between the tumblers, have not been illustrated.

In the embodiment of FIGS. 12 – 16, elements of preceding Figures have again been designated by corresponding reference numerals here preceded by a "3" in the position of the hundreds digit.

In this embodiment, the mounting of tumblers 317 – 319 on axle pins 316 is similar to that shown in FIGS. 1 – 4, except that the bores 320 are closed at the top and allow the tumblers to be separated by small clearances from the partition 315.

Figure 16:
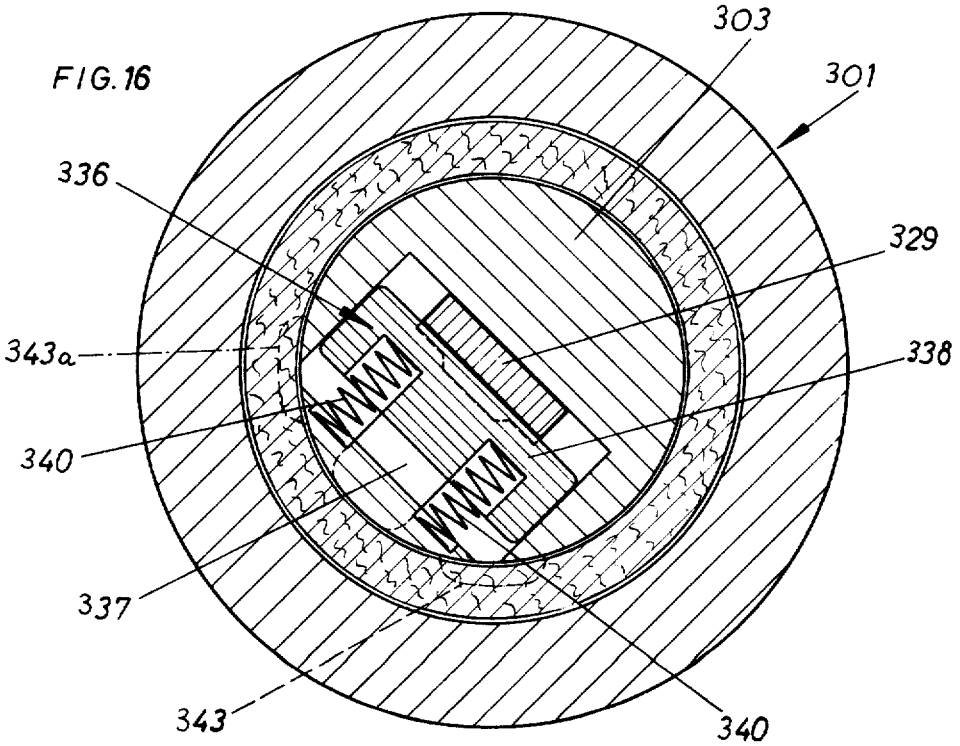
FIG. 16 is another view similar to FIG. 14, showing an off-normal position with key inserted.

The radial passage 335 of plug 303, occupied by detent 336, registers with a depression 343 of housing 301 in a normal working position of plug 303, illustrated in FIGS. 12 – 15, and with a second depression 343*a* (FIGS. 14 – 16) in an alternate position offset therefrom by 90°. In an intermediate off-normal position, as illustrated in FIG. 16, extension 337 of detent 336 rides on the inner peripheral surface of housing 301 so that the point 339 of detent 336 cannot be withdrawn from notch 344 of key 329. Detent 336 is generally T-shaped, when viewed from the front as in FIGS. 14 – 16, with extension 337 constituting the stem of the "T" whose cross-bar has been designated 338. This cross-bar has blind holes 342 confronting similar holes 341 at the bottom of passage 337, these holes receiving the ends of latch springs 340 which flank the stem 337.

Depressions 343 and 343*a* are dished, in contrast to depression 143 of FIG. 5, and are therefore not closed at the front by the packing ring 307'.

Naturally, detent 136 or 336 could also be used with a lock construction of the type shown in FIGS. 10 and 11, or indeed with otherwise conventional locks whose tumblers are not necessarily controlled by magnetic means.

It should be noted that magnets 21 etc. of the tumblers could be replaced by passive ferromagnetic elements serving as armatures for the key-supported magnets 34 etc. In such a case, however, only a small residual magnetic force exists upon the withdrawal of the key to disorient the tumblers so that supplemental biasing means may be necessary in that instance.

While I have found the provision of three tumblers entirely satisfactory, both from a mechanical viewpoint and as far as the number of possible permutations is concerned, fewer or more tumblers could of course be utilized if desired. The tumblers are well protected against dust intrusion by the locking bar 11 etc., as well as by the inserts 253 in the embodiment of FIGS. 10 and 11.

I claim:

1. A lock assembly comprising:

a cylindrical housing provided with an axially extending groove on its inner peripheral wall;

a rotatable plug in said housing provided with an axially extending cavity open toward the periphery thereof, said cavity registering with said groove in a normal rotary position of said plug;

locking means in said cavity provided with biasing means urging same radially outwardly for engagement with said groove in said normal position, said groove and said locking means having complementary profiles provided with sloping flanks for camming said locking means generally radially inwardly upon incipient rotation of said plug from said normal position;

a plurality of axially spaced tumblers in said cavity independently rotatable about generally radial axes, said plug being provided with an axially extending key slot adjacent said cavity;

a key having a shank insertable into said key slot;

control means on said shank effective upon full insertion thereof to place each of said tumblers in a predetermined angular position, said locking means and said tumblers being provided with complementary formations matingly confronting one another in said angular positions but preventing inward camming of said locking means in any other position of said tumblers, said control means comprising a set of first magnets on said shank, said tumblers being provided with second magnets offset from the axes thereof attractable by said first magnets, said plug forming a thin, magnetically pervious partition between said key slot and said cavity;

a plurality of pins rising from said partition and forming bearing axles for said tumblers, said locking means comprising a bar paralleling said partition, said biasing means comprising a plurality of axially spaced compression springs interposed between said partition and said bar, said complementary formations comprising projections on said bar and recesses on said tumblers, said tumblers being disk-shaped and said recesses being located at the disk peripheries thereof, the axes of said tumblers lying in an axial plane of said plug perpendicular to said partition, said projections being offset from said axial plane, said groove and said bar having generally trapezoidal cross-sections with radially outwardly converging sides, the width of said cavity slightly exceeding the major base of the trapezoid of the bar whereby said bar is limitedly tiltable in said cavity, said bar being provided with lateral teeth extending from said major base on at least one side of said axial plane and bracketing said projections, said teeth being longer than said projections and being brought into contact with an adjoining cavity wall by a tilting of said bar upon an incipient rotation of said plug blocked by nonalignment of at least one projection with a recess on a confronting tumbler.

2. A lock assembly as defined in claim 1, wherein said plug being provided with an axially extending channel open to said key slot, said shank being formed with a longitudinal rib fitting into said channel for establishing a definite insertion position for said shank.

3. A lock assembly as defined in claim 1 wherein at least one of said tumblers is provided with two recesses registering with a corresponding projection on said bar in alternate angular tumbler positions.

4. A lock assembly as defined in claim 1 wherein said bar is slidable along said partition in a direction perpendicular to said axial plane, said projections extending in said perpendicular direction toward said axial plane, said recesses being peripheral cutouts on said tumblers.

5. A lock assembly as defined in claim 4 wherein said plug is formed with axially spaced apertures overlying said tumblers, further comprising inserts in said apertures forming counterbearings in line with said pins for said tumblers.

6. A lock assembly as defined in claim 5 wherein said inserts have heels opposite said projections forming backstops for said tumblers.

7. A lock assembly as defined in claim 4 wherein the axes of said tumblers lying in an axial plane of said plug perpendicular to said partition, said projections being offset from said axial plane, said plug being formed with axially spaced apertures overlying said tumblers, further comprising inserts in said apertures forming counter-bearings in line with said pins for said tumblers, said inserts having heels opposite said projections forming backstops for said tumblers.

8. A lock assembly as defined in claim 1 wherein said plug is provided at an entrance end of said key slot with a transverse passage, further comprising a detent slidable in said passage and spring means urging said detent into said key slot, said housing having a depression engageable by an extension of said detent for immobilizing said plug in said housing, said key having a beveled tip for camming said detent into an immobilizing position upon beginning insertion of said shank into said key slot, said key further having a notch receiving said detent upon full insertion of said shank into said key slot for releasing said detent from said immobilizing position to permit rotation of said plug in said housing while blocking the withdrawal of said key in an off-normal rotary position of said plug.

9. A lock assembly as defined in claim 8 wherein said housing is provided with a second depression angularly offset from the first-mentioned depression and engageable by said extension in an alternate rotary position of said plug for facilitating withdrawal of said key.

10. A lock assembly as defined in claim 8 wherein said plug is provided with an axially extending channel open to said key slot, said shank being formed with a longitudinal rib fitting into said channel for establishing a definite insertion position for said shank, said notch being a discontinuity in said rib.

11. A lock assembly as defined in claim 8 wherein said detent has a sloping front edge obstructing said key slot in the absence of said key.

* * * * *